US005669834A

United States Patent [19]

Slupskiy

[11] Patent Number: 5,669,834

[45] Date of Patent: Sep. 23, 1997

[54] VOLLEYBALL BLOCKING TRAINING DEVICE

[76] Inventor: Lentiy Slupskiy, 240 Mt. Vernon, Newark, N.J. 07106

[21] Appl. No.: 602,062

[22] Filed: Feb. 15, 1996

[51] Int. Cl.[6] ..... A63B 69/00

[52] U.S. Cl. ..... 473/459

[58] Field of Search ..... 273/411, 413, 273/414, 1.5 A; 473/459

[56] References Cited

U.S. PATENT DOCUMENTS 4,948,150 8/1990 Daly, Jr. et al. ..... 273/411

5,060,946 10/1991 Taylor ..... 273/411

5,238,251 8/1993 Staka ..... 273/411

*Primary Examiner*—William H. Grieb

*Attorney, Agent, or Firm*—Ilya Zborovsky

[57] ABSTRACT

A volleyball blocking training device has a substantially upright support having an upper end, a ball imitating element arranged on the upper end of the support and adapted to be acted upon by a player during training in a blocking mode, an indicating unit for indicating when the player has acted upon the ball imitating element in a blocking mode.

9 Claims, 2 Drawing Sheets

VOLLEYBALL BLOCKING TRAINING DEVICE

BACKGROUND OF THE INVENTION

The present invention relates to a volleyball blocking training device.

Blocking of attacking strikes in volleyball is one of the main factors in successful defensive actions of a team. At the same time it is one of the most complicated elements of the technique from the point of view of its utilization during a game. When a player does not have a sufficiently high skill level in blocking, the team cannot count on successful game. At the same time it is a well known fact that players of the teams of all levels usually neglect training in order to develop blocking which is a key component of the game. Several reasons can be attributed to this strange fact. First of all it is believed that while substantial physical efforts are needed for blocking of attacking strikes, the players succeed in blocking very seldom and as a result they are not satisfied with their efforts. Also, since there are no objective criteria for determination of skill growth of athletes, the interest for training is usually at a very low level. These reasons can be overcome when an efficient motivating training to develop corresponding blocking skills is provided.

SUMMARY OF THE INVENTION

Accordingly, it is an object of the present invention to provide a training device which can train players to develop blocking skills.

In keeping with these objects and with others which will become apparent hereinafter, one feature of the present invention resides, briefly stated, in a volleyball blocking training device which includes an upright support, a ball imitating element arranged on an upper end of said support, and indicating means formed so that when a player strikes the ball imitating element in a blocking mode the indicating means indicates that the strike in the blocking mode has been delivered.

In accordance with another important feature of the present invention, the indicating means includes a light source which is activated by a trainer or coach so as to emit light, and when the player delivers a strike in a blocking mode the light source is deactivated so that it no longer emits the light.

When the volleyball blocking training device is designed in accordance with the present invention, it substantially increases of athletes to train for improving their blocking skills, and also improves their physical abilities and skills for blocking. After certain use of the inventive volleyball blocking training device, the speed of reaction and speed of corresponding (response) actions is increased, the coordination of movements near the net and over the net is improved, the athlete develops a skill of transferring his arms far over the net with a subsequent striking of the ball, the athletes also develops the skill of "hanging over" the net for an operational analysis of the action of an attacking player from the opposite team, the actions of blocking as a whole can be trained, which makes the training conditions very close to natural conditions during the game. The device is especially helpful for setters who frequently must block suddenly the strikes of a player from the opposite team, when the ball moves to its side. The device also contributes to substantially objective evaluation of the players actions since it uses corresponding measuring means such as an electric pace clock and a measuring tape. Also, with the device it is possible to organize competitions which imitate natural conditions of the game.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
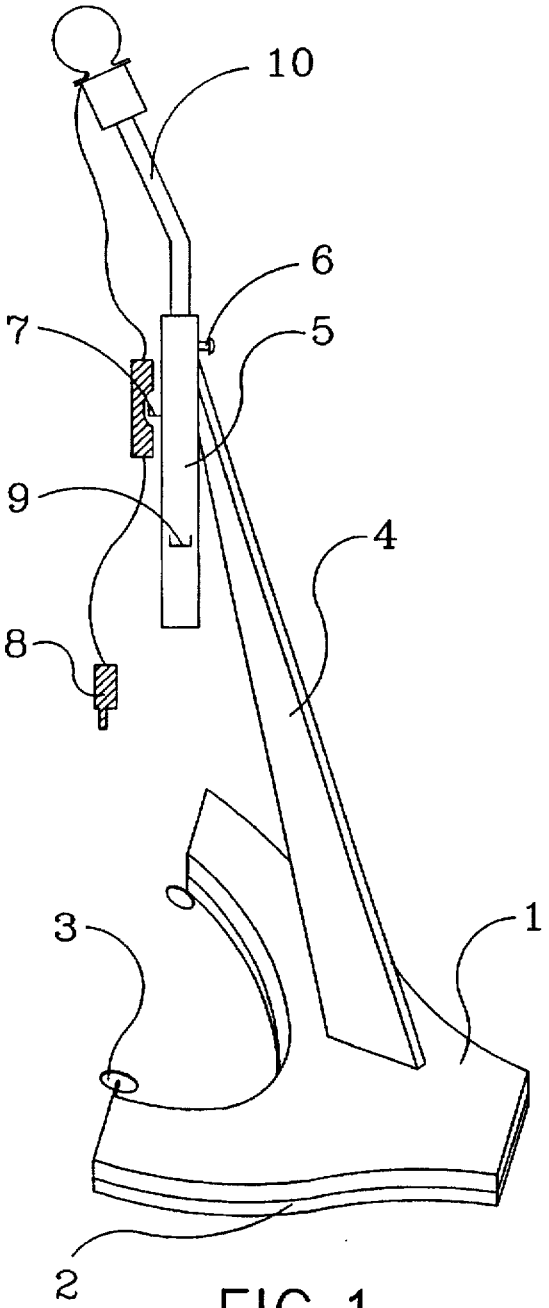
FIG. 1 is a view schematically showing a volleyball blocking training device in accordance with the present invention.
Figure 2:
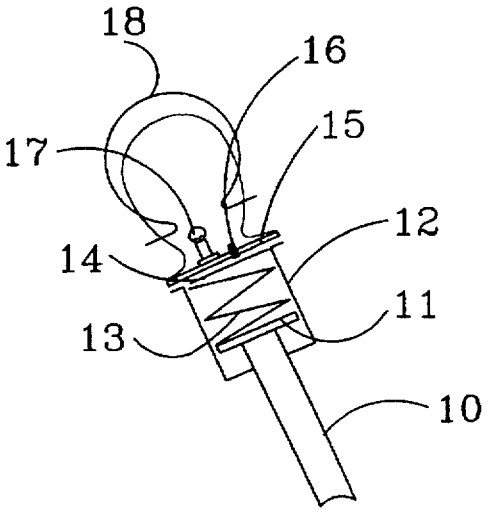
FIG. 2 is a view showing a unit of indicating means of the inventive volleyball blocking training device.
Figure 3:
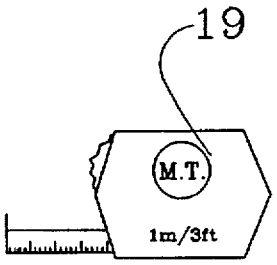
FIG. 3 is a view showing a measuring tape.
Figure 4:
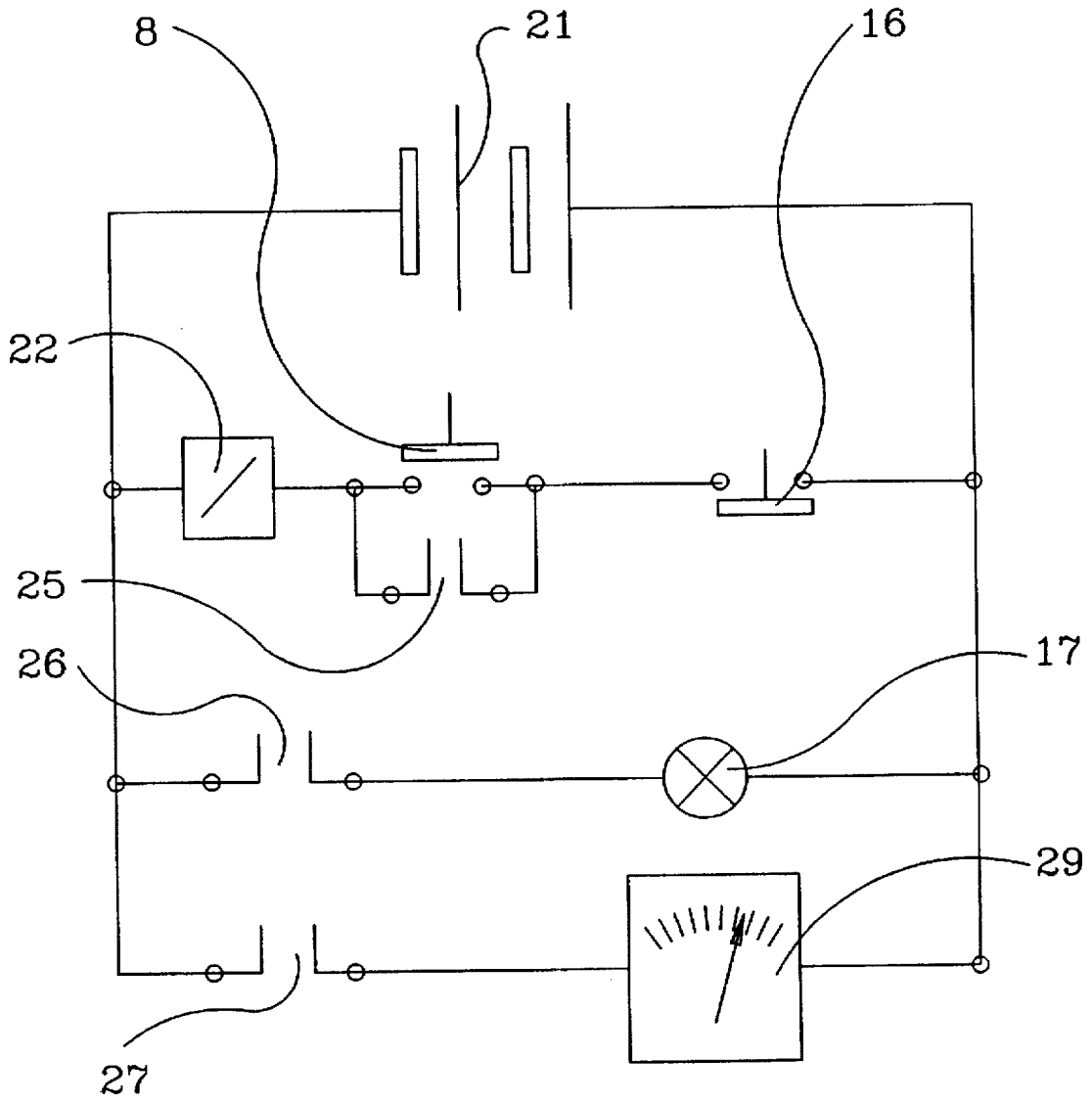
FIG. 4 is a view showing an electric diagram of control means of the inventive volleyball blocking training device.

A volleyball blocking training device has a heavy Y-shaped base 1 provided with a rubber layer 2 and rubber wheels 3. An inclined upright support 4 extends from the base 1 upwardly at an angle of approximately 25°–30° relative to a vertical line and has an upper part provided with a standard 5. The standard has a fixing bolt 6, a hook for suspending a box 7 with an electric pace clock 29 and a control unit, an on-off switch 8, a hook 9 for suspending a measuring tape 19. A holder 10 is inserted in the hollow standard 5 and fixed there by the bolt 6. The holder 10 is provided with a contact platform 11 arranged in a cylindrical contact box 12 and provided with a return spring 13 and a washer 14 with an opening for passage of a switch. An upper cover 15 is provided with a switch 16 and a three-way electric bulb 17. A plastic hood 18 which is formed as a ball is colored preferably in a dark red color. The hood 18 is at least partially spherical and at least partially transparent. The electric pace clock 29 is a standard five second electric pace clock. The measuring tape 19 is a standard 1 meter measuring tape.

The circuit for the inventive volleyball blocking training device includes an electric battery 21, a relay 22, the on-off switch 26 activated by a trainer or coach to turn on the electric bulb 17, which switch is normally open, the switch 16 activated by a player which switch is normally closed. Reference numerals 25, 26, and 27 identify first, second and third steps of the relay.

The inventive volleyball blocking training device operates in the following manner. The device is arranged near a net at a certain height above the net and a certain distance from the net, with the use of the measuring tape which for this purpose can be held on the hook 9 without removing it from the hook. A player stands at an opposite side of the net opposite to the device or sideways of the device (for blocking after movement). A trainer or coach signals to the athlete by activating the electric bulb 17 which results in the bright red light emitted from the hood 18. In response the athlete, during jumping from its place of after a movement, jump above the net transferring his arms across the net and presses the hood 18 with its both arms in a blocking mode until the light in the hood disappears as a result of the contact between the switch 16 and the contact platform 11. At the same time, the electric pace clock is stopped as well.

Immediately after lending or even in the air the athlete can see the results of its actions. It is measured in tenth of seconds, for example 2.5 seconds. When the electric pace clock is set back to 0, the next exercise can be performed.

It will be understood that each of the elements described above, or two or more together, may also find a useful application in other types of constructions differing from the types described above.

While the invention has been illustrated and described as embodied in a volleyball blocking training device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

It is claimed:

1. A volleyball blocking training device, comprising a substantially upright support having an upper end; a ball imitating element arranged on said upper end of said support and adapted to be acted upon by a player during training in a blocking mode; an indicating means for indicating when the player has acted upon said ball imitating element in a blocking mode; and spring means provided between said ball imitating element and said substantially upright support so that when a player acts on said ball imitating element during training in a blocking mode, said spring means compresses, and then after the action said spring means relaxes and displace said ball imitating element to its initial position.

2. A volleyball blocking training device as defined in claim 1, wherein said ball imitating element is arranged movably relative to said support so as to activate said indicating means upon a movement of said ball imitating element caused by acting by the player on said ball imitating element.

3. A volleyball blocking training device as defined in claim 1; and further comprising a measuring tape suspended on said support so as to measure a height of said ball imitating element above a net and a distance from said ball imitating element to the net without removing said measuring tape from said support; and further comprising means for suspending said measuring tape on said support.

4. A volleyball blocking training device as defined in claim 1; and further comprising a base, said support extending from said base upwardly at an angle of approximately 25°–30° relative to a vertical line.

5. A volleyball blocking training device as defined in claim 4; and further comprising a rubber layer located under said base, and rubber wheels connected with said base for transportation purposes.

6. A volleyball blocking training device, comprising a substantially upright support having an upper end; a ball imitating element arranged on said upper end of said support and adapted to be acted upon by a player during training in a blocking mode; an indicating means for indicating when the player has acted upon said ball imitating element in a blocking mode, said indicating means including a light source activated when the player acts upon said ball imitating element.

7. A volleyball blocking training device as defined in claim 6, wherein said indicating means includes a first switch which is operated by a coach so as to activate said light source for emitting light from said light source, and a second switch which, when the player acts on said ball imitating element, deactivates said light source so that no light is emitted by said light source.

8. A volleyball blocking training device as defined in claim 7, wherein said ball imitating element is formed as an at least partially transparent hood, said light source being arranged inside said hood.

9. A volleyball blocking training device, comprising a substantially upright support having an upper end; a ball imitating element arranged on said upper end of said support and adapted to be acted upon by a player during training in a blocking mode; an indicating means for indicating when the player has acted upon said ball imitating element in a blocking mode; and an electric pace clock associated with said indicating means and activated when the player acts upon said ball imitating element so as to indicate time from a moment when said electric pace clock is set by a coach until a moment when the player acts upon said ball imitating element.

* * * * *